US010429775B1

(12) United States Patent
Cao et al.

(10) Patent No.: US 10,429,775 B1
(45) Date of Patent: Oct. 1, 2019

(54) THERMAL CONTROL OF FUSER ASSEMBLY IN AN IMAGING DEVICE

(71) Applicant: LEXMARK INTERNATIONAL, INC., Lexington, KY (US)

(72) Inventors: Jichang Cao, Lexington, KY (US); John Lemaster, Lexington, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 15/991,360

(22) Filed: Jun. 20, 2018

(51) Int. Cl.
*G03G 15/20* (2006.01)
*H05B 3/00* (2006.01)
*G03G 15/00* (2006.01)
*H05B 3/26* (2006.01)

(52) U.S. Cl.
CPC ..... *G03G 15/2039* (2013.01); *G03G 15/205* (2013.01); *G03G 15/5004* (2013.01); *H05B 3/265* (2013.01); *H05B 2203/002* (2013.01)

(58) Field of Classification Search
CPC ..... G03G 15/2053; G03G 15/2039; G03G 15/5004; G03G 2215/2035; G03G 15/205; H05B 3/265; H05B 2203/002; H05B 2203/004
USPC ..... 399/69; 219/216
See application file for complete search history.

(56) References Cited

U.S. PATENT DOCUMENTS 5,376,773 A 12/1994 Masuda et al.
6,177,657 B1 * 1/2001 Takata ..... G03G 15/2003 219/216
6,336,009 B1 1/2002 Suzumi et al.
7,193,180 B2 * 3/2007 Cook ..... H05B 1/0205 219/216
7,321,738 B2 1/2008 Kaji et al.
8,494,383 B2 7/2013 Shimura et al.
2011/0142472 A1 * 6/2011 Mitsuoka ..... G03G 15/2039 399/69
2013/0272738 A1 * 10/2013 Kawakami ..... G03G 15/205 399/69
2015/0331368 A1 * 11/2015 Asano ..... G03G 15/2039 399/69
2016/0044745 A1 2/2016 Nakayama et al.
2017/0023894 A1 1/2017 Cao et al.
2017/0205740 A1 7/2017 Cao et al.
2018/0074442 A1 3/2018 Cao

* cited by examiner

*Primary Examiner* — Robert B Beatty

(57) ABSTRACT

An imaging device includes a controller and fuser assembly. The fuser assembly has a heat transfer and backup member defining a nip and process direction of media travel. The heat transfer member includes a resistive trace with a length twice extending transverse to the process direction. The controller selectively applies AC power to the resistive trace. The controller calculates a power level from zero power to full power to heat the trace to a predetermined set-point temperature from a measured current temperature. The controller maps the calculated power level to one of only eight actual heating power levels that become applied or not to the resistive trace to achieve a desired power flicker and harmonics response otherwise unattainable by merely applying the calculated power level. The actual heating power levels include differing numbers of consecutive half-cycles of AC power and are applied at zero-crossings thereof.

8 Claims, 5 Drawing Sheets

THERMAL CONTROL OF FUSER ASSEMBLY IN AN IMAGING DEVICE

FIELD OF THE DISCLOSURE

The present disclosure relates to controlling a fuser assembly in an electrophotographic imaging device, and particularly to tightly controlling temperature in the fuser assembly while minimizing power flicker and harmonics.

DESCRIPTION OF THE RELATED ART

In an electrophotographic (EP) imaging process used in laser printers, copiers and the like, a photosensitive member, such as a photoconductive drum or belt, is uniformly charged over an outer surface. An electrostatic latent image is formed by selectively exposing the uniformly charged surface of the photosensitive member. Toner particles are applied to the electrostatic latent image, and thereafter the toner image is transferred to a media sheet intended to receive the final image. The toner image is fixed to the media sheet through application of heat and pressure in a fuser assembly. The fuser assembly includes a heated roll and a backup roll forming a fuser nip through which the media sheet passes. Alternatively, the fuser assembly includes a fuser belt, a heater disposed within the belt around which the belt rotates, and an opposing backup member, such as a backup roll.

Imaging devices typically draw power from an electrical power grid, i.e., the AC (alternating current) mains, in order to operate. During a fusing operation, the fuser assembly draws relatively large amounts of power to heat the fuser which may cause large voltage variations which, in turn, may generate severe harmonics and noticeable flicker. In most geographical locations, regulation entities set strict flicker and harmonics requirements to reduce their undesirable effects on persons and sensitive electronic/electrical equipment. Manufacturers of imaging devices are continuingly challenged to reduce harmonics and flicker generated during fusing operations while not compromising temperature control performance.

Also, as future Energy Star/Blue Angel requirements, for example, set forth lower power consumption during times of non-printing, manufacturers anticipate there will no longer exist standby modes of fuser operation. Rather, fuser assemblies will operate in either print mode or sleep mode. In turn, fuser assemblies will need to power faster from cold temperature, sleep mode to fully-heated, print mode to meet time-to-first-print (TTFP) criteria. However, simply increasing the power of a heater having a single resistive trace from 1200 W to 1400 W, for example, to meet the TTFP results in severe power harmonics, flicker, or both. A need exists, therefore, to power heaters fast, but minimize harmonics and flicker.

With heaters having multiple resistive traces, a controller can alternate the application of power to the traces such that small changes in power result in relatively low flicker and no harmonics, provided power is applied at zero-crossings. But power levels for multiple traces cannot be effectively applied in the same manner to heaters having but a single resistive trace. A further need exists, therefore, to apply power to a single resistive trace while minimizing power flicker and harmonics. As the inventors further recognize, this need also contemplates the constraints imposed by imaging varieties of differing types of media, including avoiding temperature undershoot and overshoot when achieving temperature control.

SUMMARY

Embodiments of the present disclosure provide systems and methods for tight temperature controls of a fuser assembly in an imaging device, while minimizing or eliminating power flicker and harmonics. In an example embodiment, an imaging device includes a controller and fuser assembly. The fuser assembly has a heat transfer and backup member defining a nip and process direction of media travel. The heat transfer member includes a resistive trace with a length twice extending transverse to the process direction. The controller selectively applies AC power to the resistive trace. The controller calculates a power level from zero power (0%) to full power (100%) to heat the trace to a predetermined target or set-point temperature from a measured current temperature. The controller maps the calculated power level to one of only eight actual heating power levels that become applied or not to the resistive trace to achieve a desired power flicker and harmonics response otherwise unattainable by merely applying the calculated power level. The actual heating power levels include differing numbers of consecutive half-cycles of AC power and are applied at zero-crossings thereof. Still other embodiments are disclosed.

DETAILED DESCRIPTION

Figure 1:
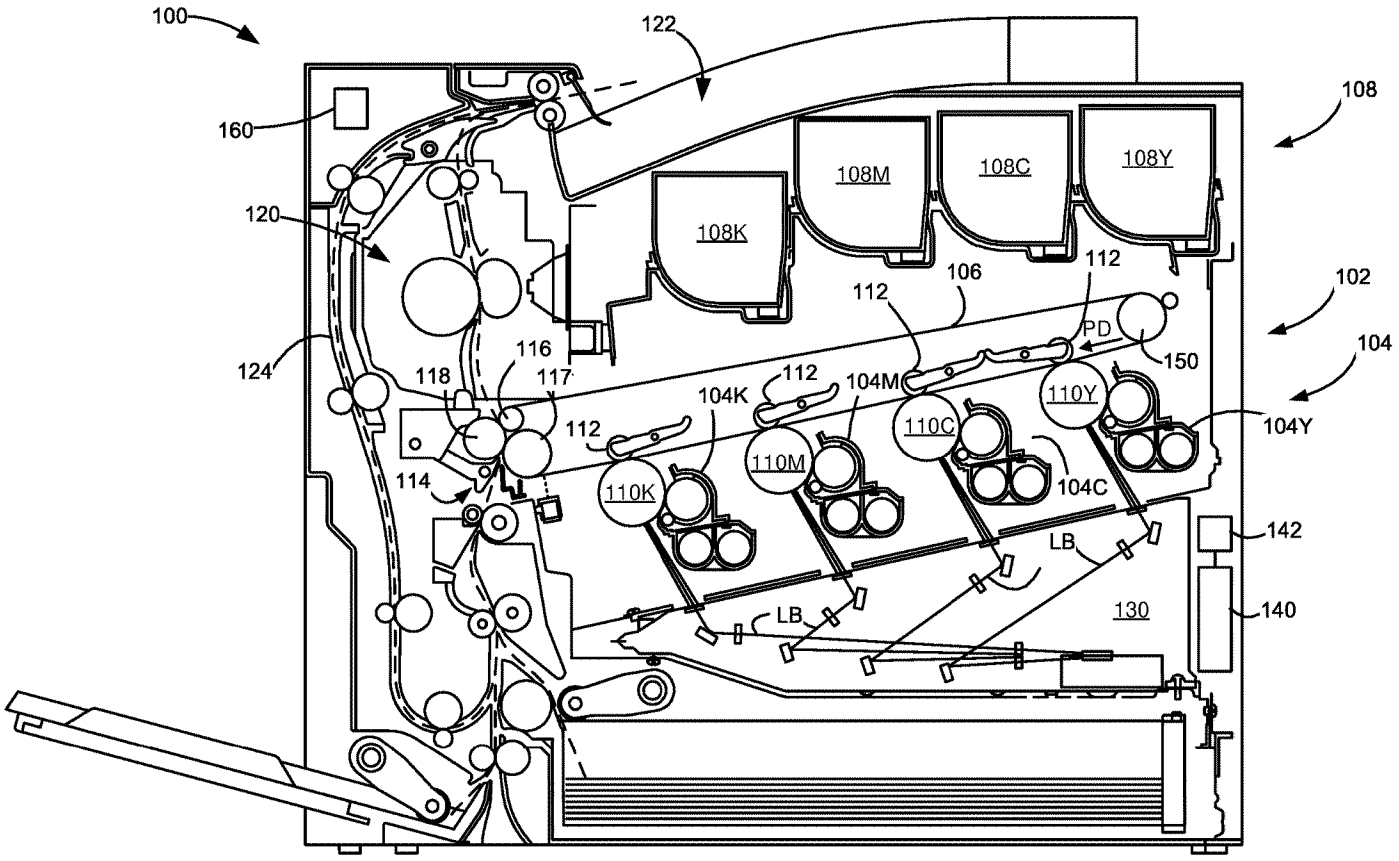
FIG. 1 is a diagrammatic view of an imaging device including a fuser assembly according to an example embodiment.

FIG. 1 illustrates a color imaging device 100 according to an example embodiment. It includes a first toner transfer area 102 having four developer units 104Y, 104C, 104M and 104K that substantially extend from one end of imaging device 100 to an opposed end thereof. They are disposed along an intermediate transfer member (ITM) 106. Each developer unit 104 holds a different color of toner. The developer units 104 are aligned in order relative to a process direction PD of the ITM belt 106, with the yellow developer unit 104Y being the most upstream, followed by cyan developer unit 104C, magenta developer unit 104M, and black developer unit 104K being the most downstream along ITM belt 106.

Each developer unit 104 is operably connected to a toner reservoir 108 for receiving toner for use in a printing operation. Each toner reservoir 108Y, 108C, 108M and 108K is controlled to supply toner as needed to its corresponding developer unit 104. Each developer unit 104 is associated with a photoconductive member 110Y, 110C, 110M and 110K that receives toner therefrom during toner development in order to form a toned image thereon. Each photoconductive member 110 is paired with a transfer member 112 for use in transferring toner to ITM belt 106 at first transfer area 102.

During color image formation, the surface of each photoconductive member 110 is charged to a specified voltage, such as −800 volts, for example. At least one laser beam LB from a printhead or laser scanning unit (LSU) 130 is directed to the surface of each photoconductive member 110 and discharges those areas it contacts to form a latent image thereon. In one embodiment, areas on the photoconductive member 110 illuminated by the laser beam LB are discharged to approximately −100 volts. The developer unit 104 then transfers toner to photoconductive member 110 to form a toner image thereon. The toner is attracted to the areas of the surface of photoconductive member 110 that are discharged by the laser beam LB from LSU 130.

ITM belt 106 is disposed adjacent to each of developer unit 104. In this embodiment, ITM belt 106 is formed as an endless belt disposed about a backup roll 116, a drive roll 117 and a tension roll 150. During image forming or imaging operations, ITM belt 106 moves past photoconductive members 110 in process direction PD as viewed in FIG. 1. One or more of photoconductive members 110 applies its toner image in its respective color to ITM belt 106. For monocolor images, a toner image is applied from a single photoconductive member 110K. For multi-color images, toner images are applied from two or more photoconductive members 110. In one embodiment, a positive voltage field formed in part by transfer member 112 attracts the toner image from the associated photoconductive member 110 to the surface of moving ITM belt 106.

ITM belt 106 rotates and collects the one or more toner images from the one or more developer units 104 and then conveys the one or more toner images to a media sheet at a second transfer area 114. Second transfer area 114 includes a second transfer nip formed between back-up roll 116, drive roll 117 and a second transfer roller 118. Tension roll 150 is disposed at an opposite end of ITM belt 106 and provides suitable tension thereto.

Fuser assembly 120 is disposed downstream of second transfer area 114 and receives media sheets with the unfused toner images superposed thereon. In general terms, fuser assembly 120 applies heat and pressure to the media sheets in order to fuse toner thereto. After leaving fuser assembly 120, a media sheet is either deposited into an output media area 122 or enters a duplex media path 124 for transport to second transfer area 114 for imaging on a second surface of the media sheet.

Imaging device 100 is depicted in FIG. 1 as a color laser printer in which toner is transferred to a media sheet in a two-step operation. Alternatively, imaging device 100 may be a color laser printer in which toner is transferred to a media sheet in a single-step process—from photoconductive members 110 directly to a media sheet. In another alternative embodiment, imaging device 100 may be a monochrome laser printer which utilizes only a single developer unit 104 and photoconductive member 110 for depositing black toner directly to media sheets. Further, imaging device 100 may be part of a multi-function product having, among other things, an image scanner for scanning printed sheets.

Imaging device 100 further includes a controller 140 and memory 142 communicatively coupled thereto. Though not shown in FIG. 1, controller 140 may be coupled to components and modules in imaging device 100 for controlling same. For instance, controller 140 may be coupled to toner reservoirs 108, developer units 104, photoconductive members 110, fuser assembly 120 and/or LSU 130 as well as to motors (not shown) for imparting motion thereto. It is understood that controller 140 may be implemented as any number of controllers, circuits, processors and the like for suitably controlling imaging device 100 to perform printing operations.

Still further, imaging device 100 includes a power supply 160. In one example embodiment, power supply 160 includes a low voltage power supply which provides power to many of the components and modules of imaging device 100 and a high voltage power supply for providing a high supply voltage to modules and components requiring higher voltages, such as the photoconductive members.

Figure 2A:
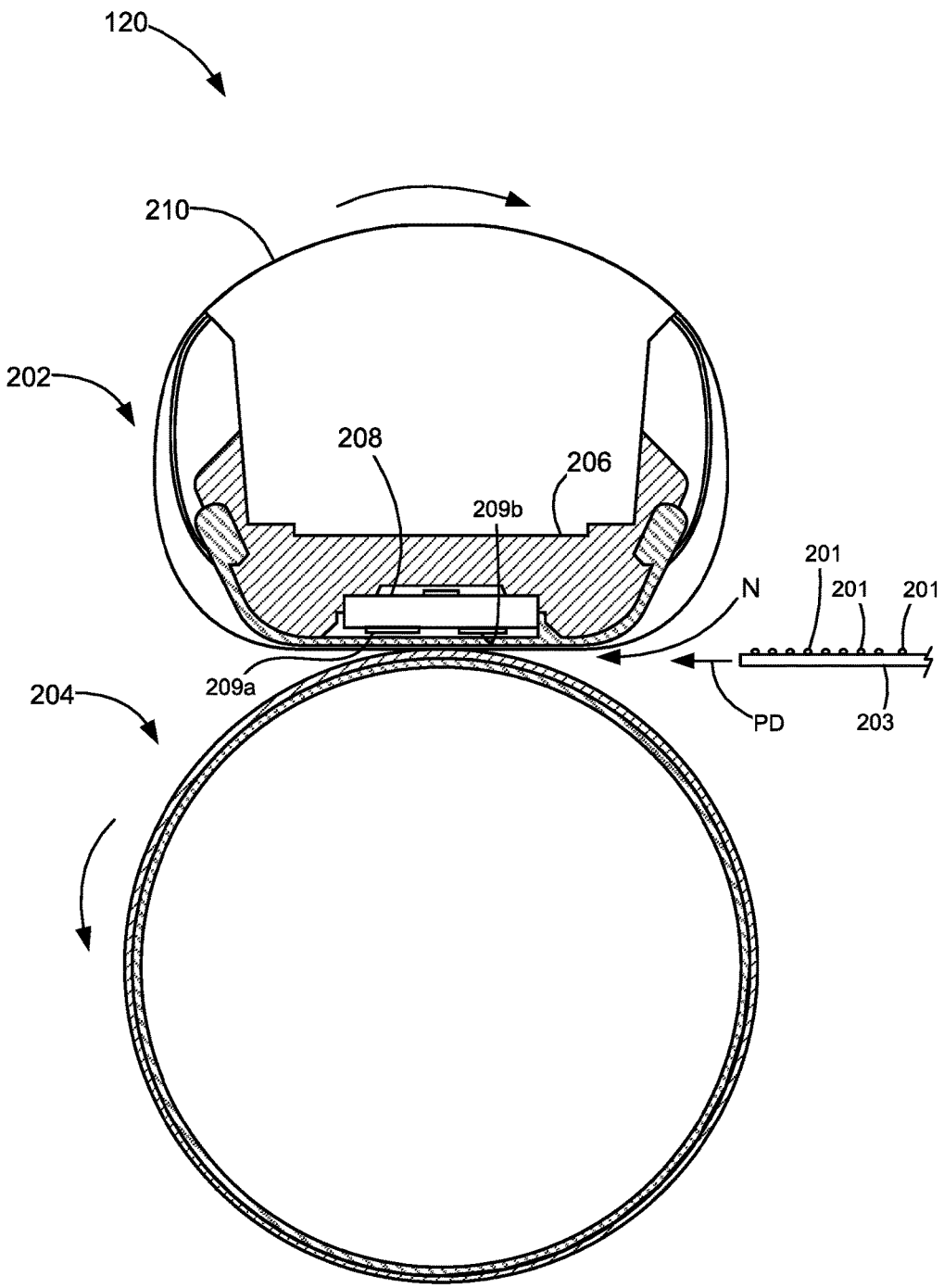
FIG. 2A is a diagrammatic view of a representative fuser assembly.
Figure 2B:
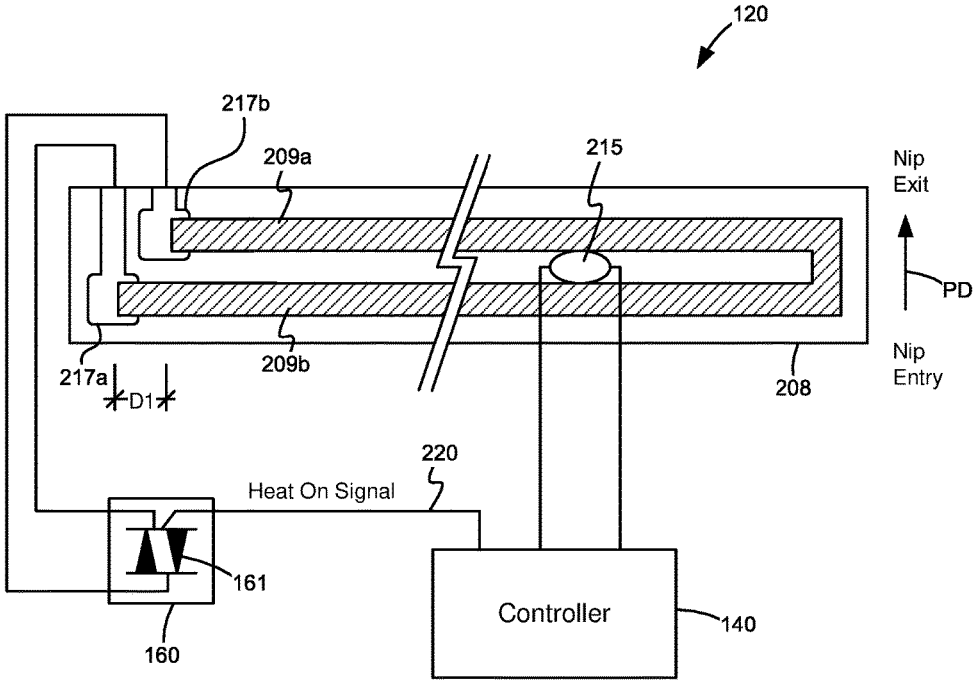
FIG. 2B is a diagrammatic view of a resistive trace and control therefor in an imaging device.

With respect to FIG. 2A, in accordance with an example embodiment, there is shown a more detailed fuser assembly 120 for use in fusing toner 201 to sheets of media 203 through application of heat and pressure. Fuser assembly 120 includes a heat transfer member 202 and a backup member 204 cooperating to define a fuser nip N for conveying the media sheets in a process direction (PD) from a nip entry to nip exit. The heat transfer member 202 includes a housing 206, a heater member 208 supported on or at least partially in housing 206, and an endless flexible fuser belt 210 positioned about housing 206. Heater member 208 is formed from a substrate of ceramic or like material to which a single resistive trace 209 is secured which generates heat when a current is passed through it as regulated by the controller 140, as seen in FIG. 2B. The controller regulates the current upon application of a heat-on signal 220 to the power supply 160 as switched through a triac 161. In turn, the triac connects to ends of the resistive trace 209 to supply power at conductive pads 217*a*, 217*b*. Also, a length of the resistive trace extends twice, generally parallel, in a direction transverse to the process direction (PD) of media travel, noted by trace segments 209*a*, 209*b*. Ends of the trace segments may terminate at different distances from a reference-edge to assist in fusing media sheets having differing widths, such as letter or A4. Their separation is noted at distance D1. Also, a total length of the resistive trace extends in a range from about 350 to 450 mm. Its width extends in a range from about 2 to 6 mm. The power rating of the trace is relatively high and exists in a range from about 1000 to 1500 W. One or more thermistors 215 are also arranged with the resistive trace 209 to provide feedback to the controller 140 regarding the current temperature of the trace.

With reference also to FIG. 2A, the inner surface of fuser belt 210 contacts the outer surface of heater member 208 so that heat generated by heater member 208 heats fuser belt 210. Fuser belt 210 is disposed around housing 206 and heater member 208. Backup member 204 contacts fuser belt 210 such that fuser belt 210 rotates about housing 206 and heater member 208 in response to backup member 204 rotating. Alternatively, the motor rotates the fuser belt 210, which causes rotation of the backup member 204. In either, the controller governs the speed of rotation in a feedback relationship with a motor that rotates the backup member or the fuser belt. With fuser belt 210 rotating around housing 206 and heater member 208, the inner surface of fuser belt 210 contacts heater member 208 so as to heat fuser belt 210 to a temperature sufficient to perform a fusing operation to fuse toner to sheets of media. Fuser belt 210 and backup member 204 may be constructed from the elements and in the manner as disclosed in U.S. Pat. No. 7,235,761, which is assigned to the assignee of the present application and whose contents is incorporated by reference. It is understood, though, that fuser assembly 120 may have a different fuser belt architecture or even a different architecture altogether. That is, fuser assembly 120 may be a hot roll fuser, including a heated roll and a backup roll engaged to form a fuser nip through which media sheets traverse. The hot roll fuser may include an internal or external heater member for heating the heated hot roll, such as a high power lamp having a single filament. The hot roll fuser may further include a backup belt assembly. Those skilled in the art can contemplate still other embodiments.

Figure 3:
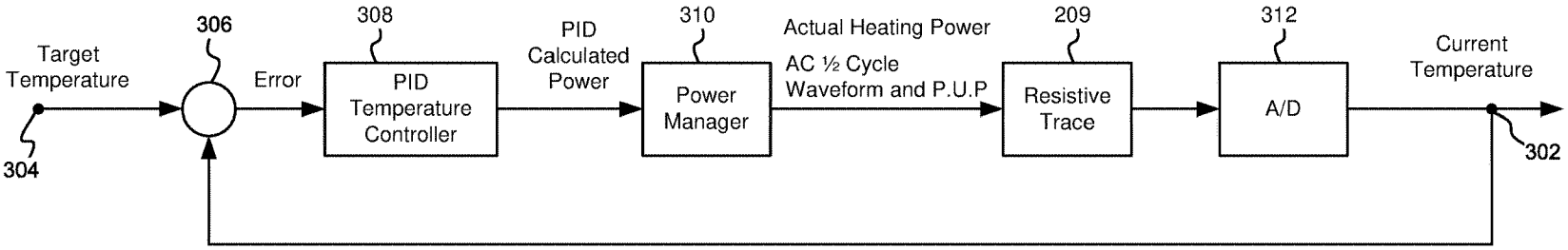
FIG. 3 is block diagram for thermal control of a fuser assembly.

With reference to FIG. 3, fusing temperature for fusing media sheets is controlled by measuring the current temperature of the fuser assembly and adjusting that upward or downward to achieve a predetermined set-point or target temperature. The controller enables the application of power to the fuser assembly by way of the power supply applying power or not to the resistive trace. In a feedback loop, the controller knows both the current temperature 302 of the resistive trace of the fuser assembly and the set-point or target temperature 304 at which fusing operations are to occur. The current temperature is obtained from the one or more thermistors. The target temperature comes from the memory and is preconfigured for access by the controller. Criteria for setting the target temperature includes operating parameters, such as the type of media sheets being imaged (e.g., plain paper, cardstock, label, etc.), the imaging speed of the imaging operation (e.g., 70 pages per minute (ppm), 25 ppm, etc.), whether the imaging operation includes color or mono imaging, and the like. At 306, the controller calculates a difference or 'error' between the current temperature and the target temperature. If there is no error, or within a margin of tolerance, then the target temperature and the current temperature equal one another and fusing operations can commence immediately.

If not equal, on the other hand, the error is supplied to a proportional-integral-derivative (PID) Temperature Controller 308 to determine what power value should be applied to the fuser assembly in order to achieve the desired heat generation by the resistive trace to drive the current temperature of the resistive trace to become the target temperature. In other words, if the current temperature is 410° F., and the desired target temperature for fusing is 435° F., power needs to be applied to fuser assembly to increase the temperature of the resistive trace by 25° F. by the time the media sheets arrive at the fuser nip, or 435° F.−410° F.=25° F. But to increase the temperature of the resistive trace, the controller needs to first determine how much power is needed to drive this increase in temperature. At the same time, however, the controller does not want to drive the resistive trace with too much power, thereby overshooting the target temperature. Similarly, the controller does not want to underdrive the resistive trace, thereby undershooting or never reaching the target temperature. The controller merely wants to get the temperature of the resistive trace to the exact temperature, the target temperature, as fast as possible, but without temperature overshoot or undershoot or power harmonics or flicker.

During use, the heating power calculated by PID Temperature Controller occurs at a predetermined frequent interval, but faster than the time period of the frequency of the AC power operating at 50 or 60 Hz, typically. Thus, on the order of every five (5) msec, the PID Temperature Controller calculates the heating power required to drive the resistive trace and such ranges as a power value anywhere from 0% to 100%, inclusive. Yet, to meet various flicker and harmonics requirements of the many geographies, the inventors have observed that the controller cannot actually energize the resistive trace of the fuser assembly with the exact power calculated by PID Temperature Controller. Namely, power levels greater than 0% and less than 33% were observed to generate flicker that was too severe for applying to the resistive trace noted in FIG. 2B. On the other hand, the inventors found that the application of power within the range from 30% to 75% was acceptable if the maximum power level increase or decrease to the resistive trace equaled or was less than a 10% difference from the last application of power to the trace. The ≤10% application of power is also much smaller than some prior art systems that apply 25% increases or decreases to dual (two) resistive traces, which now results in tighter temperature control over the known art.

As a result, the power calculated by the PID Temperature Controller (PID Calculated Power (%)) is next sorted into a range of power values, empirically derived, that falls into one of eight possible ranges noted in Table 1, either: (1) 0-15%; (2) 16-30%; (3) 31-40%; (4) 41-50%; (5) 51-65%; (6) 66-75%; (7) 76-85%; or (8) 86-100%, inclusive.

TABLE 1

Power Mapping from PID Temperature Controller

| PID Calculated Power (%) | Actual Heating Power (%) |
|---|---|
| (1) 0%-15% | 0% |
| (2) 16%-30% | 33% |
| (3) 31%-40% | 40% |
| (4) 41%-50% | 50% |
| (5) 51%-65% | 60% |
| (6) 66%-75% | 66% |
| (7) 76%-85% | 80% |
| (8) 86%-100% | 100% |

In turn, a Power Manager 310 maps the PID Calculated Power, within one of the eight ranges, to a single, Actual Heating Power (%), i.e. 0%, 33%, 40%, 50%, 60%, 66%, 80%, and 100% that will be applied to the resistive trace of the fuser assembly, instead of the calculated power. As examples of mapping, if the PID Calculated Power corresponds to 35%, that value is found in the range (3) extending from 31% to 40%, inclusive, and is mapped to an Actual Heating Power of 40%. Similarly, if the PID Calculated Power corresponds to 74%, that value is found within the range (6) extending from 66%-75%, inclusive, and is mapped to 66%, and so on. In any range, to actually apply the Actual Heating Powers of either 0%, 33%, 40%, 50%, 60%, 66%, 80%, or 100% to the resistive trace 209 of the fuser assembly, reference is taken to Table 2, below. In that, the Power Manager 310 supplies empirically-derived Alternating Current (AC) half cycle waveforms to the resistive trace, per a period of application (Power Update Period (P.U.P), to optimally balance acceptable temperature control and levels of flicker for the resistive trace.

TABLE 2

| Actual Heating Power (%) | AC Half-Cycle Waveform and Power Update Period: AC Half Cycle Number 1 | 2 | 3 | 4 | 5 | 6 | 7 | 8 | 9 | 10 | 11 | 12 | 13 | 14 | 15 | 16 | Power Update Period |
|---|---|---|---|---|---|---|---|---|---|---|---|---|---|---|---|---|---|
| 0% | 0 | 0 | N/A | N/A | N/A | N/A | N/A | N/A | N/A | N/A | N/A | N/A | N/A | N/A | N/A | N/A | 2 Half Cycles |
| 33% | 1 | 0 | 0 | 1 | 0 | 0 | N/A | N/A | N/A | N/A | N/A | N/A | N/A | N/A | N/A | N/A | 6 Half Cycles |
| 40% | 1 | 0 | 0 | 1 | 0 | N/A | N/A | N/A | N/A | N/A | N/A | N/A | N/A | N/A | N/A | N/A | 5 half Cycles |
| 50% | 0 | 1 | 0 | 1 | 0 | 1 | 0 | 1 | 1 | 0 | 1 | 0 | 1 | 0 | 1 | 0 | 16 half cycles |
| 60% | 1 | 0 | 1 | 0 | 1 | 1 | 0 | 1 | 0 | 1 | N/A | N/A | N/A | N/A | N/A | N/A | 10 half cycles |
| 66% | 1 | 0 | 1 | 1 | 0 | 1 | N/A | N/A | N/A | N/A | N/A | N/A | N/A | N/A | N/A | N/A | 6 Half Cycles |
| 80% | 1 | 1 | 1 | 1 | 0 | N/A | N/A | N/A | N/A | N/A | N/A | N/A | N/A | N/A | N/A | N/A | 5 half Cycles |
| 100% | 1 | 1 | N/A | N/A | N/A | N/A | N/A | N/A | N/A | N/A | N/A | N/A | N/A | N/A | N/A | N/A | 2 Half Cycles |

Figure 4A:
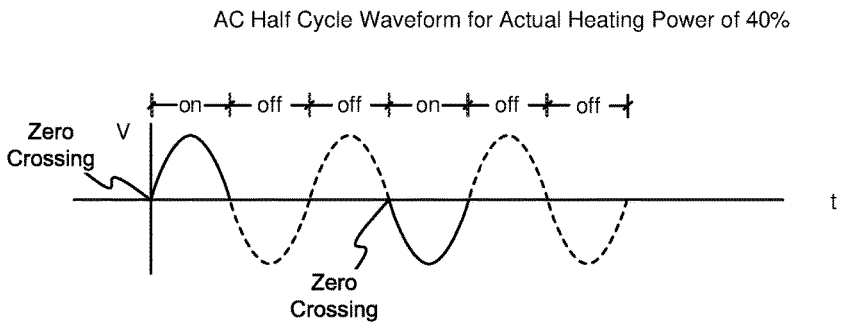
FIGS. 4A and 4B are graphs illustrating representative voltage waveforms of Table 2 for application to a resistive trace of a fuser assembly.

To use the Table, a 1 or 0 indicates that power gets applied or not to the resistive trace, thus turning it on or off, respectively. Using the entry of Actual Heating Power of 33%, the resistive trace is powered on for half cycles numbered 1 and 4 and powered off for half cycles numbered 2, 3, 5 and 6. That the resistive trace is powered on for only two half cycles (1 and 4) out of the six total half cycles of the Power Update Period, this results in power being applied to the resistive trace in an amount of 33%, or two half cycles divided by six total half cycles, or $\frac{2}{6}$=33%. To minimize DC offset, by cancelling positive cycles of voltage with negative cycles, if the half cycle numbered 1 is a positive half cycle, the half cycle numbered 4 is a negative half cycle, or vice versa. FIG. 4A gives an illustration. Application of the half cycles also begins and ends at zero (voltage) crossings of the waveform to reduce, if not eliminate, the generation of harmonics in the power system.

Figure 4B:
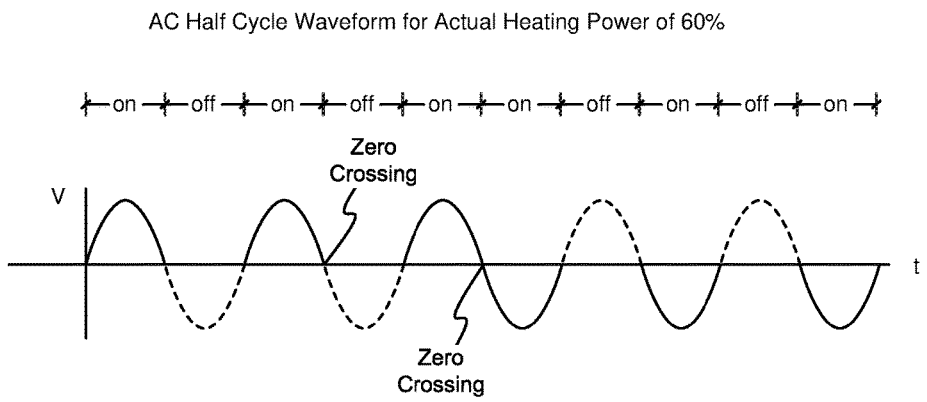

In FIG. 4B, the AC half-cycle waveform for the Actual Heating Power of 60% is illustrated for comparison. It shows that half cycles numbered 1, 3, 5, 6, 8 and 10 power 'on' the resistive trace, while half cycles numbered 2, 4, 7 and 9 leave 'off' the resistive trace. That its Power Update Period extends for ten half cycles, and six of those (1, 3, 5, 6, and 10) power on the resistive trace, the resistive trace is powered on in an amount of 60%, or six half cycles divided by ten total half cycles, or $\frac{6}{10}$=60%. To minimize DC offset, three of the six half cycles powering on the resistive trace are positive voltage cycles, i.e., 1, 3, and 5, and three of the six half cycles are negative voltage cycles, i.e., 6, 8, and 10, or vice versa. In either embodiment, the time period for the AC half-cycles varies with frequency of the voltage waveform, e.g., 50 or 60 Hz depending on geography. In turn, the total 'on time' or total 'off time' of any AC half cycle waveform may be calculated per any Actual Heating Power.

With reference back to FIG. 3, artisans should appreciate that the PID Thermal Controller 308 calculated a given power level from zero power (0%) to full power (100%) to heat the heater member of the fuser assembly, but the Power Manager 310, perhaps, applied a different power level to the resistive trace. In turn, the heater member may not heat or cool as the PID Thermal Controller expected it to according to its calculation. An error then exists that the controller characterizes in A/D 312 and integrates at 308. In turn, the process repeats for as often as necessary until the resistive trace reaches its Target Temperature. As illustration, if the PID Thermal Controller calculated a PID Calculated Power of 65%, the Power Manager ends up only applying an AC half cycle waveform of 60% to the resistive trace as mapped per the range (5) in Table 1, 51%-65%: 60%. Thus, the resistive trace is not heating as fast as the PID Thermal Controller expects and takes this into account to heat faster the resistive trace during the next iteration of the feedback process. On the other hand, if the PID Thermal Controller calculated a PID Calculated Power of 86, the Power Manager ends up applying an AC half cycle waveform of full power 100% to the resistive trace as mapped per the range (8) in Table 1, e.g., 86%-100%: 100%. Thus, the resistive trace heats much faster than the PID Thermal Controller expects and integrates this error to avoid overshooting the target temperature of the resistive trace during the next iteration of the feedback process. That the Power Update Period for the Actual Heating Power of 100% is relatively short at only two (2) consecutive half cycles and for 60% is relatively longer at ten (10) consecutive half cycles (Table 2), this is what limits the resistive trace from overshooting or undershooting its Target Temperature. As seen, full power is only applied to the resistive trace for a very limited amount of time (two half cycles) because the trace will heat rapidly, but power can be applied to the trace for a longer time (e.g., 10 half cycles) when not being applied at full power as the trace does not heat as rapidly. Similarly, zero power (0%) is only applied to the resistive trace for a limited amount of time (two half cycles) because the trace will cool rapidly, but power can be applied for a longer time at six (6) half cycles when only applying power of 33%, for example, as the trace does not cool as rapidly. Still other embodiments are possible.

Advantages of the present disclosure include, but are not limited to: tight steady-state temperature control of the single resistive trace, which cannot be achieved using multi-cycle power control for dual resistive traces; unique AC half cycle waveforms exhibiting minimal flicker per the derived Actual Heating Powers; differing Power Update Periods to prevent temperature undershoot and overshoot; and unique mapping of calculated power levels to Actual Heating Powers.

The foregoing illustrates various aspects of the invention. It is not intended to be exhaustive. Rather, it is chosen to provide the best mode of the principles of operation and practical application known to the inventors so one skilled in the art can practice it without undue experimentation. All modifications and variations are contemplated within the scope of the invention as determined by the appended claims. Relatively apparent modifications include combining one or more features of one embodiment with those of another embodiment.

The invention claimed is:

1. An imaging device with a fuser assembly to fuse toner to media sheets in a process direction of media travel, the fuser assembly connectable to a supply of AC power, comprising:

a heater member and a backup member engaged to form a fusing nip having a nip entry and nip exit in the process direction of media travel, the heater member having a resistive trace; and a controller for selectively applying to the resistive trace consecutive half cycles of the AC power at zero-crossings thereof including calculating a power level from zero power (0%) to full power (100%) inclusive to cause the resistive trace to heat to a predetermined set-point temperature from a measured current temperature but mapping the calculated power level to one of only eight actual heating power levels whereby the resistive trace is turned on for 0%, 33%, 40%, 50%, 60%, 66%, 80%, or 100% of the consecutive half cycles.

2. The imaging device of claim 1, wherein the controller is further configured to recalculate said power level in less time than a period of the half-cycles of the AC power being applied to the resistive trace.

3. The imaging device of claim 2, wherein the controller is further configured to recalculate said power level every 5 msec.

4. The imaging device of claim 1, wherein the resistive trace has a length twice extending transverse to the process direction.

5. The fuser assembly of claim 1, wherein the resistive trace defines a filament in a lamp.

6. The fuser assembly of claim 1, further including one or more thermistors configured with the resistive trace to provide to the controller the current temperature.

7. The fuser assembly of 1, wherein the consecutive half cycles number is two, five, six, ten or sixteen consecutive half-cycles.

8. The fuser assembly of claim 1, wherein the controller further includes a PID thermal controller to calculate the power level.

* * * * *